US006059405A

United States Patent [19]

Mochizuki et al.

[11] Patent Number: 6,059,405

[45] Date of Patent: May 9, 2000

[54] INK-JET RECORDING APPARATUS

[75] Inventors: Seiji Mochizuki; Shuichi Yamaguchi; Akio Owatari, all of Nagano, Japan

[73] Assignee: Seiko Epson Corporation, Tokyo, Japan

[21] Appl. No.: 09/116,205

[22] Filed: Jul. 16, 1998

[30] Foreign Application Priority Data

Aug. 1, 1997 [JP] Japan ..... 9-220902
Aug. 1, 1997 [JP] Japan ..... 9-220903

[51] Int. Cl.[7] ..... B41J 2/19

[52] U.S. Cl. ..... 347/92

[58] Field of Search ..... 347/92, 85, 88, 347/89

[56] References Cited

U.S. PATENT DOCUMENTS

| | | | |
|---|---|---|---|
| 4,285,727 | 8/1981 | Uehara et al. | 106/22 |
| 4,320,407 | 3/1982 | Goldis et al. | 347/92 |
| 4,342,042 | 7/1982 | Cruz-Uribe et al. | 347/7 |
| 4,460,904 | 7/1984 | Oszczakiewicz et al. | 364/75 |
| 4,729,773 | 3/1988 | Shirato et al. | 55/158 |
| 4,869,732 | 9/1989 | Kalfoglou | 55/16 |
| 4,995,940 | 2/1991 | Hine et al. | 156/629 |
| 5,159,348 | 10/1992 | Dietl et al. | 347/89 |
| 5,485,187 | 1/1996 | Okamura et al. | 347/85 |
| 5,621,446 | 4/1997 | Tanaka et al. | 347/85 |
| 5,963,237 | 10/1999 | Ikkatai et al. | 347/85 |

FOREIGN PATENT DOCUMENTS 558294 9/1993 European Pat. Off. .

OTHER PUBLICATIONS

Patent Abstracts of Japan, vol. 097, No. 006, Feb. 10, 1997 (Canon Inc.).

Patent Abstracts of Japan, vol. 018, No. 554 (M–1691), Jul. 19, 1994 (Murata Mach Ltd.).

*Primary Examiner*—N. Le
*Assistant Examiner*—Michael Nghiem
*Attorney, Agent, or Firm*—Sughrue, Mion, Zinn, Macpeak & Seas, PLLC

[57] ABSTRACT

An ink container contains main tanks into which ink can be poured from the outside and the ink in the main tanks is supplied to recording heads via deaerators incorporating hollow fibers to which negative pressure is applied from the outside. The ink in the ink tanks is deaerated by the deaerators before an ink-end condition is brought on and then supplied to the recording heads.

20 Claims, 8 Drawing Sheets

INK-JET RECORDING APPARATUS

BACKGROUND OF THE INVENTION

The present invention relates to an ink-jet recording apparatus for printing data on large-sized recording media using ink-jet recording heads and more particularly to an ink supply unit.

As an ink-jet recording apparatus is used to do a large quantity of printing by reciprocating recording heads in the width direction of recording paper while ink is supplied from ink supply sources to the recording heads, what is designed to do a large quantity of printing follows a method of supplying ink to recording heads via tubes connected to ink supply sources contained in a casing is followed.

Since such an ink-jet recording apparatus is so arranged as to generate ink drops by pressurizing ink in pressure generating chamber, the pressurizing force of the ink will lower if bubbles are contained in the ink, thus lowering the discharge performance of the ink drops as well. Consequently, it is necessary to supply ink containing no dissolved air to the recording heads.

For the reason stated above, ink which is sufficiently deaerated at factories, enclosed in ink cartridges or ink bags and packaged in air-insulated containers have been offered on a commercial basis.

In the case of an ink-jet recording apparatus for use in printing posters and the like using large-sized recording media, however, a large quantity of ink is consumed at the time of printing. Consequently, as shown in FIG. 5, there has been employed an ink cartridge as an ink supply means comprising a flexible ink bag A for enclosing deaerated ink, and an ink-end detecting plate B for operating an ink end detector in ink-near-end and ink-end conditions, the ink bag A and the plate B being contained in a casing C, C'.

The ink bag A is formed of an aluminum laminate film comprising two sheets of films, for example, an outer nylon film and an inner polyethylene film with aluminum foil as an intermediate layer in order to secure the gas barrier property. The ink bag A flexibly deforms in proportion to the quantity of ink without damaging the deaerated property.

However, it is necessary to increase the strength of the bag material needs increasing and increase the rigidity of the bag as the quantity of ink as well as the volume of the bag is increased. The increased rigidity of the ink bag makes it difficult to smoothly supply ink to recording heads when the quantity of ink exceeds with normally about 500 cc. In other words, there is a limit the size of such an ink bag.

Moreover, the ink supply needle of an ink supply tube is inserted into a septum E formed of an elastic material such as rubber formed at an ink supply port D and this allows air to penetrate into the ink supply passage when the needle is detached. In a case where the ink supply is depleted during the printing operation, there develops a problem arising from the fact that work efficiency is lowered because the task of refilling the recording heads with ink becomes necessary.

Another problem is that the operator of the ink-jet recording apparatus may replace the ink bag with a new one even though the remainder of the ink is plenty as an absolute quantity, but still not sufficient enough to print data to be printed, thus wasting ink, or perform an ink-refilling operation.

SUMMARY OF THE INVENTION

An object of the present invention made in view of the foregoing problems is to provide an ink-jet recording apparatus which makes unnecessary not only the supply of deaerated ink from the outside but also the operation of filling recording heads with ink after the recording heads are supplied with ink.

In order to solve the problem above according to the present invention, an ink-jet recording apparatus with a carriage loaded with recording heads for discharging ink drops according to printing signals by causing liquid feeding means to supply ink from ink containers via ink supply tubes to the recording heads is such that each of the ink containers is adapted for use as a main tank to be supplied with ink by pouring from the outside and also used for supplying the recording head with the ink stored therein via hollow fibers as deaerating means which is subjected to the action of negative pressure applied from the outside.

The replenishment of deaerated ink by replacing the used ink cartridge with a new one can be made unnecessary by deaerating the ink stored in the ink tank before the ink in the ink tank is totally consumed.

According to another aspect of the invention, the ink container is used for supplying the recording head with the ink stored therein via deaerating means having ultrasonic-wave imparting means for imparting ultrasonic vibration to the ink between the main tank and the recording head.

DESCRIPTION OF THE PREFERRED EMBODIMENTS

A detailed description will subsequently be given of the present invention with reference to an embodiment thereof.

Figure 1:
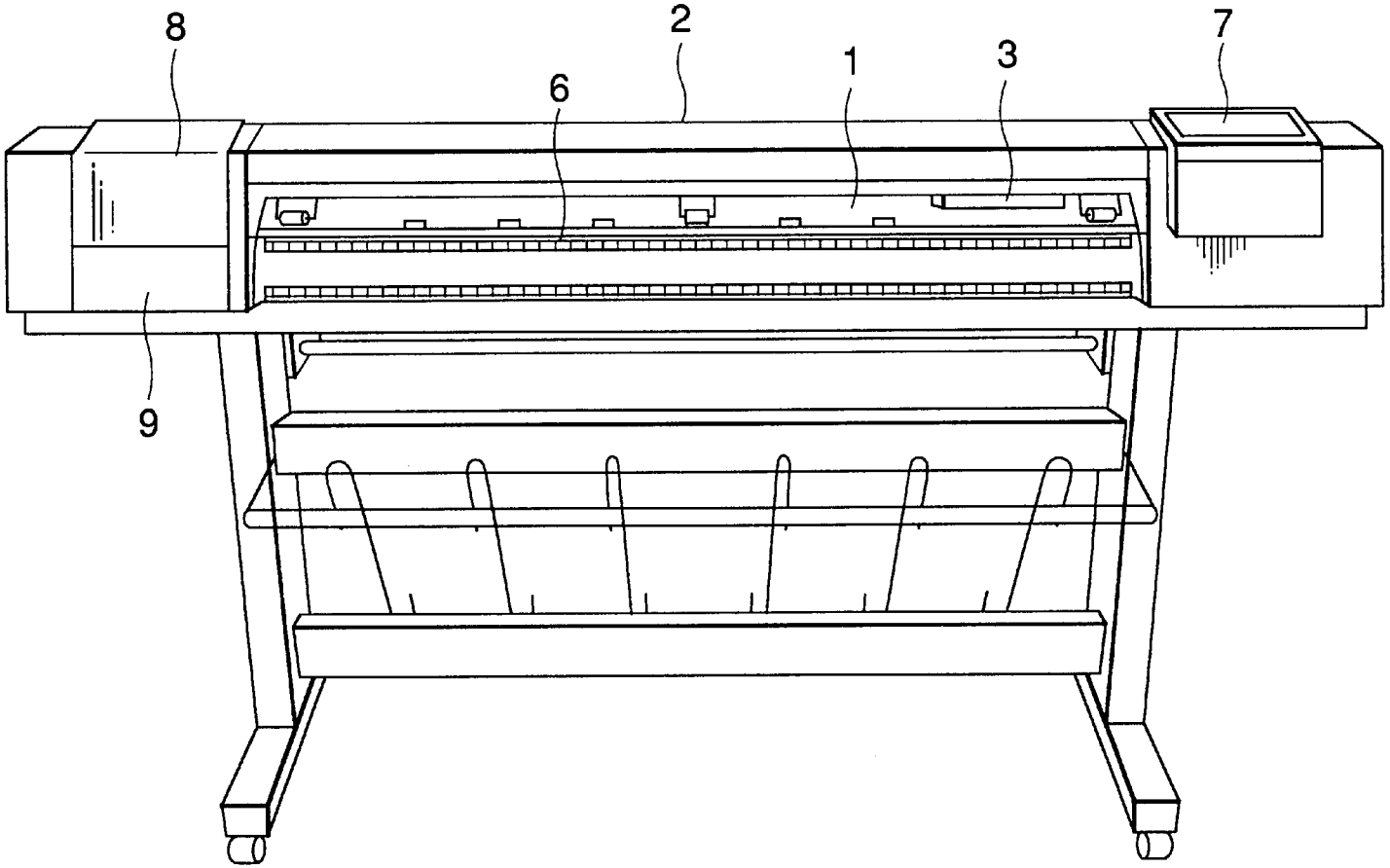
FIG. 1 is a schematic view of an ink-jet recording head embodying the present invention.

FIG. 1 shows an embodiment of the present invention comprising a frame 2 for use in forming a window 1 slightly greater in width than a recording medium as an object for printing, ink-jet recording heads 4, 5 (see FIG. 2) which are guided back and forth by a carriage 3 in the width direction of the recording medium in the upper portion of the window 1, a paper guide member 6 for supporting the recording medium in the lower portion of the window 1, a control panel 7 in one easy-to-operate end portion on the front side, and an ink tank container 9 installed on the other side of the apparatus, the ink tank container having a cover 8 that can be opened and closed.

Figure 2:
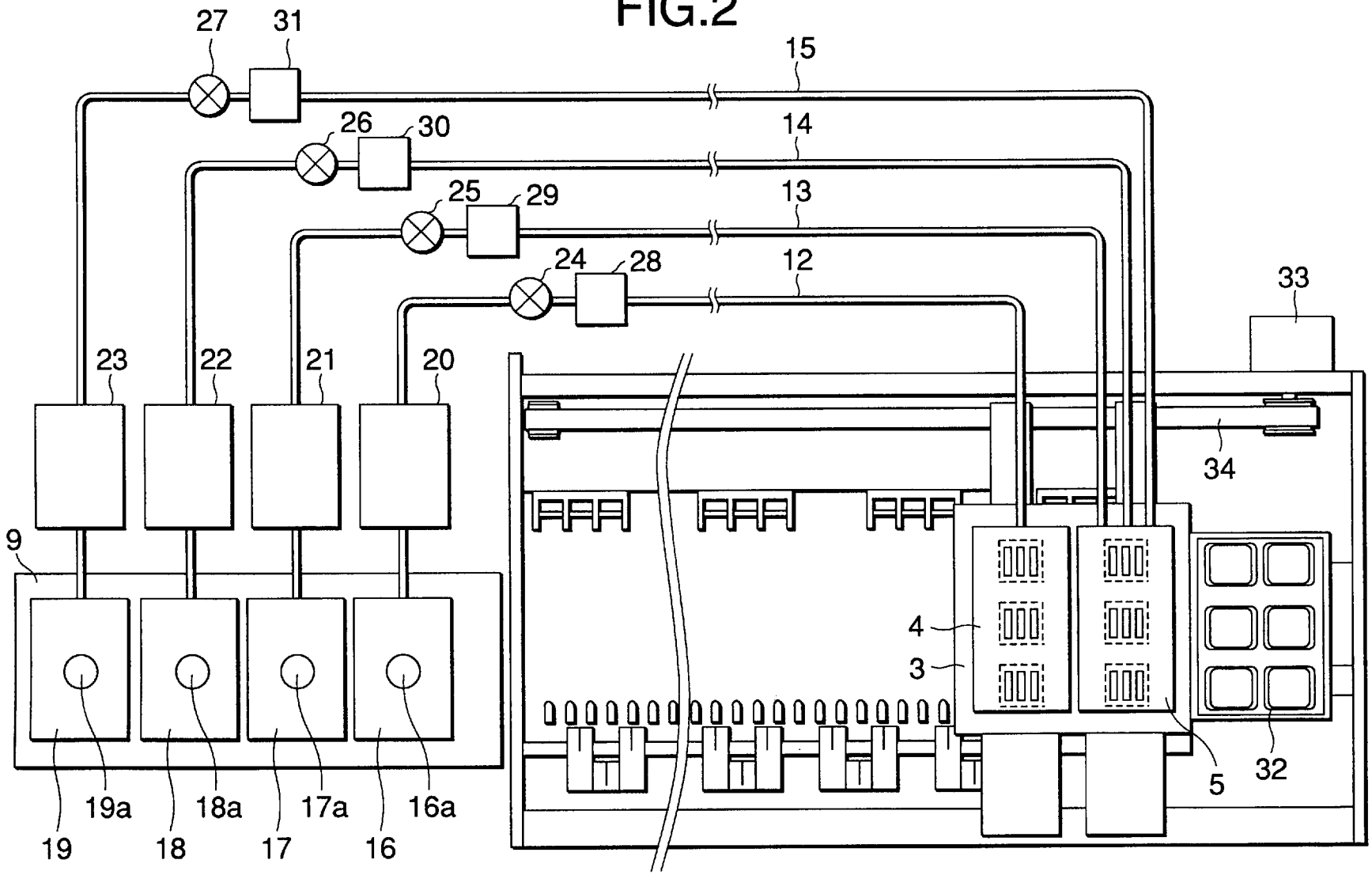
FIG. 2 is a diagram illustrating an embodiment of the invention.

FIG. 2 also shows an embodiment of the present invention wherein the carriage 3 is loaded-with the recording head 4 for discharging black ink, the recording head 5 for discharging yellow, cyan and magenta ink, and buffer tanks, if necessary, for easing the fluctuation of ink pressure originating from the reciprocation of the carriage. Ink is supplied from an ink supply system, which will be described later, via ink supply tubes 12, 13, 14, 15 and the buffer tanks, or directly to the recording heads 4, 5.

The ink supply system has main tanks 16–19 so that ink can be supplied via lids 16*a*–19*a*, deaerators 20–23, stop valves 24–27, and relay tanks 28–31 having deaerating properties. The main tanks 16–19 are provided with ink near-end detecting means 16*b*–19*b* (see 16*b* in FIG. 3), respectively.

A capping unit 32 for applying negative pressure is installed in a non-printing area in order to prevent the recording heads 4, 5 from being clogged with dried ink at the non-printing time and also to prevent the recording heads 4, 5 therefrom due to the initial filling-up. Reference numeral 33 in FIG. 2 denotes a carriage driving motor which is connected to the carriage 3 via a timing belt 34.

Figure 3:
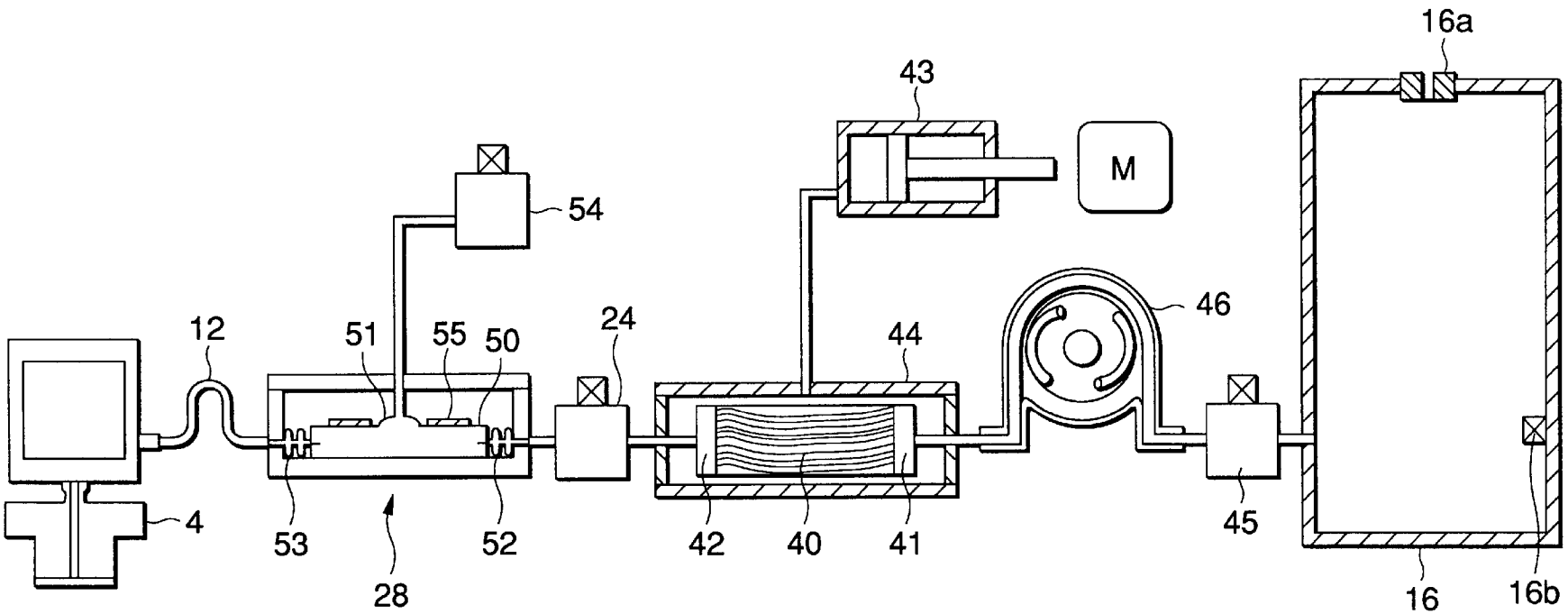
FIG. 3 is a diagram illustrating an arrangement of a flow channel in the apparatus of FIG. 2.

The deaerators 20–23 have the same construction and with reference to the deaerator 20 by way of example, it is prepared through the steps of bundling hollow fibers 40 having through-holes communicating one end with the other, banding both ends together with connecting tools 41, 42, connecting the tool to the ink supply tube 12, and accommodating the hollow fibers 40 in a sealing container 44 on which the negative pressure from a vacuum pump 43 acts, whereby it is supplied with ink through a pump 46 connected to the main tank 16 via a stop valve 45, as shown in FIG. 3.

The relay tanks 28–31 have the same construction likewise and with reference to the relay tank 28 by way of example, it is prepared through the steps of forming a flexible bag 50 as an aluminum laminate film using two sheets of films, for example, an outside nylon film and an inside polyethylene film with aluminum foil as an intermediate layer held therebetween to create c gas barrier property according to this embodiment of the invention, and forming an air reservoir 51 which is located in the uppermost position inside the bag. Further, one end is used as an inlet 52 and the other as an outlet 53, which is connected to the ink supply tube 12.

The air reservoir 51 is opened to the atmosphere via a stop valve 54 and the bag 50 also has a detecting plate 55 for detecting the degree of deformation of the bag. The ink-full condition when the bag is filled up with ink and the ink-near-end condition of the bag are made detectable by detecting the deformation of the detecting plate 55 resulting from the deformation of the bag with, for example, a limit switch (not shown).

Of the operation of the apparatus thus constructed, a description will be given of mainly ink replenishment by taking a flow channel connected to the recording head 4, for example.

The lid 16*a* of the main tank 16 is opened so as to pour ink thereinto and then the lid 16*a* is closed. The stop valve 45 is opened in this state and the vacuum pump 43 is operated to supply ink from the main tank 16 to the deaerator-20 via the liquid feeding pump 46. The ink made to flow into the hollow fibers 40 is subjected to the negative pressure applied from the outer periphery of the hollow fibers 40, so that the air contained in the ink is separated and discharged by the vacuum pump 43 into the atmosphere.

When the stop valves 24, 54 are opened at the stage of causing the air contained in the ink to be discharged, the ink flows into the relay tank 28, and the ink bag 50 forming the relay tank 28 stores the inflowing deaerated ink while discharging the inside air via the stop valve 54 into the atmosphere.

When the ink bag 50 is thus filled up with the predetermined quantity of ink, the ink-full condition is detected by the detecting plate 55, and the stop valve 24 is closed, whereby the replenishment of ink into the ink bag 50 is terminated. When the stop valve 54 is closed, the relay tank 28 is cut off from the atmosphere, and the liquid feeding pump 46 is stopped.

At the stage of finishing filling the ink bag 50 with ink, the recording head 4 is sealed up by the capping unit 32, and a suction pump (not shown) is operated to let the negative pressure act on the recording head 4 in order to fill the recording head with ink while forcing out the air in the flow channel by means of the ink therein.

When print data is output from the host at the stage of finishing filling the recording head 4 with ink, the recording head 4 performs the printing operation while discharging ink drops according to the print data. The ink bag 50 is deformed in proportion to the consumed quantity of ink in the recording head 4 and caused to supply ink to the recording head 4.

When the quantity of ink in the ink bag 50 is thus decreased up to the near-end condition, this condition is detected by the detecting plate 55. Then the vacuum pump 43 operates and the stop valve 45 is opened and more ink is deaerated with the hollow fibers 40 by supplying the ink in the main tank 16 to the deaerator 20 via the liquid feeding pump 46. At the stage of finishing the deaeration, the stop valve 54 is opened to open the ink bag 50 to the atmosphere, and the stop valve 24 in the flow channel is opened to pour the ink in the deaerator 20 into the ink bag 50.

The ink bag 50 is opened to the atmosphere and the liquid feeding pressure from the deaerator 20 does not act on the recording head 4 even in the above condition and since the flow channel from the relay tank 28 up to the recording head 4 has been filled up with the deaerated ink, the operation of filling the recording head 4 with ink is not required, so that the printing operation can be continued.

When the ink bag 50 is thus filled up with the predetermined quantity of ink, the ink-full condition is detected by the detecting plate 55, and the stop valve 24 is closed, whereby the replenishment of ink into the ink bag 50 is terminated. When the stop valve 54 is closed, the relay tank 28 is cut off from the atmosphere, and the liquid feeding pump 46 is stopped.

When the quantity of ink in the main tank 16 is thus decreased up to the near-end condition, a warning signal is output from a sensor 16*b*, and the main tank 16 is replenished with undeaerated or insufficiently-deaerated ink put into a bottle or the like. Since a quantity of ink sufficient enough to cover the quantity of printing required to perform the deaerating operation thereafter is stored in the relay tank 28 even in the near-end condition, it is unnecessary to interrupt the printing operation even when the main tank 16 is replenished with ink.

Although the independent vacuum pump 43 is provided for each deaerator according to the aforesaid embodiment of the invention, the same effect can be achieved by connecting a common vacuum pump via conduits and stop valves to the sealing container 44 for accommodating the hollow fibers 40 and operating the stop valves. Moreover, the suction pump for supplying the negative pressure to the capping unit 32 may be driven independently. By connecting branch pipes and stop valves to suction port, the negative pressure may be supplied selectively to the capping unit 32 and the deaerators 20–23 by operating the stop valves.

Figure 4:
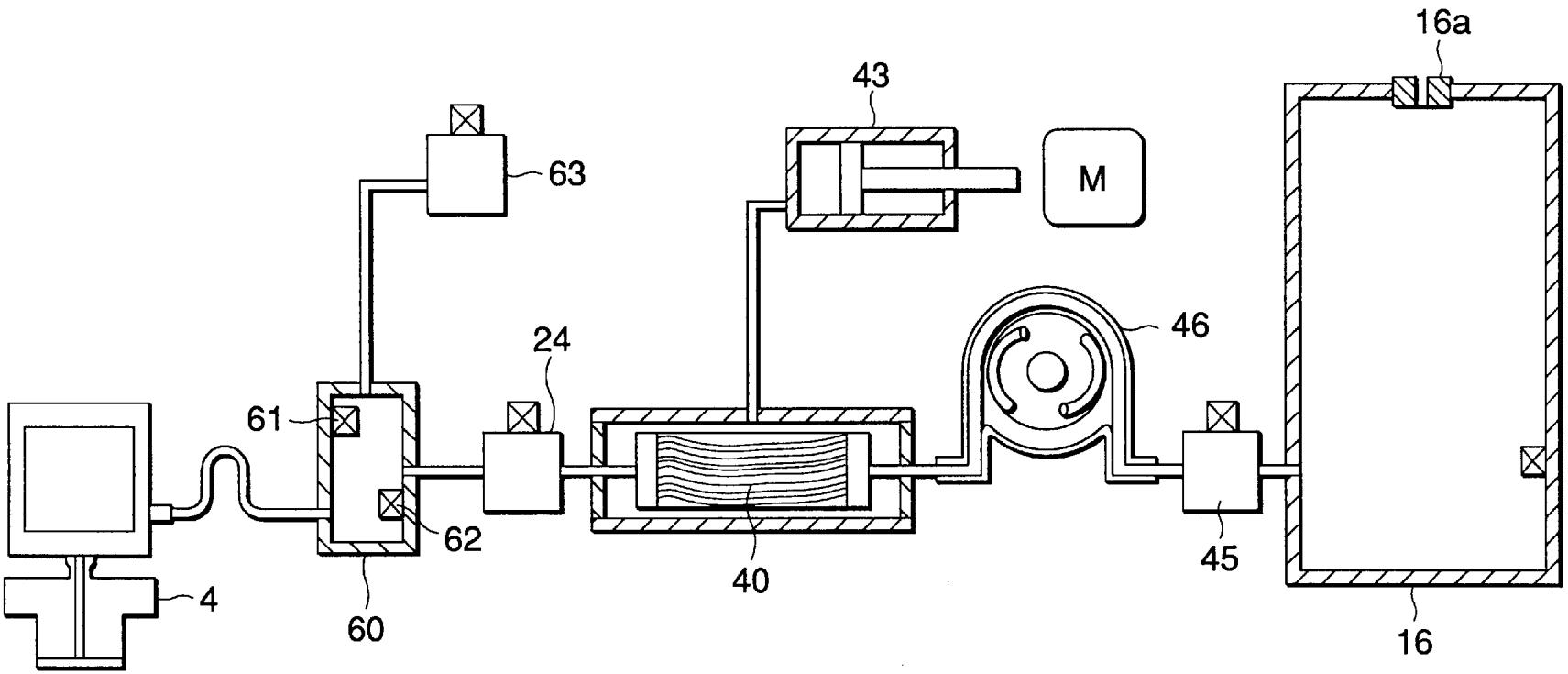
FIG. 4 is a diagram illustrating an arrangement of a flow channel in another embodiment of the invention.
Figure 5:
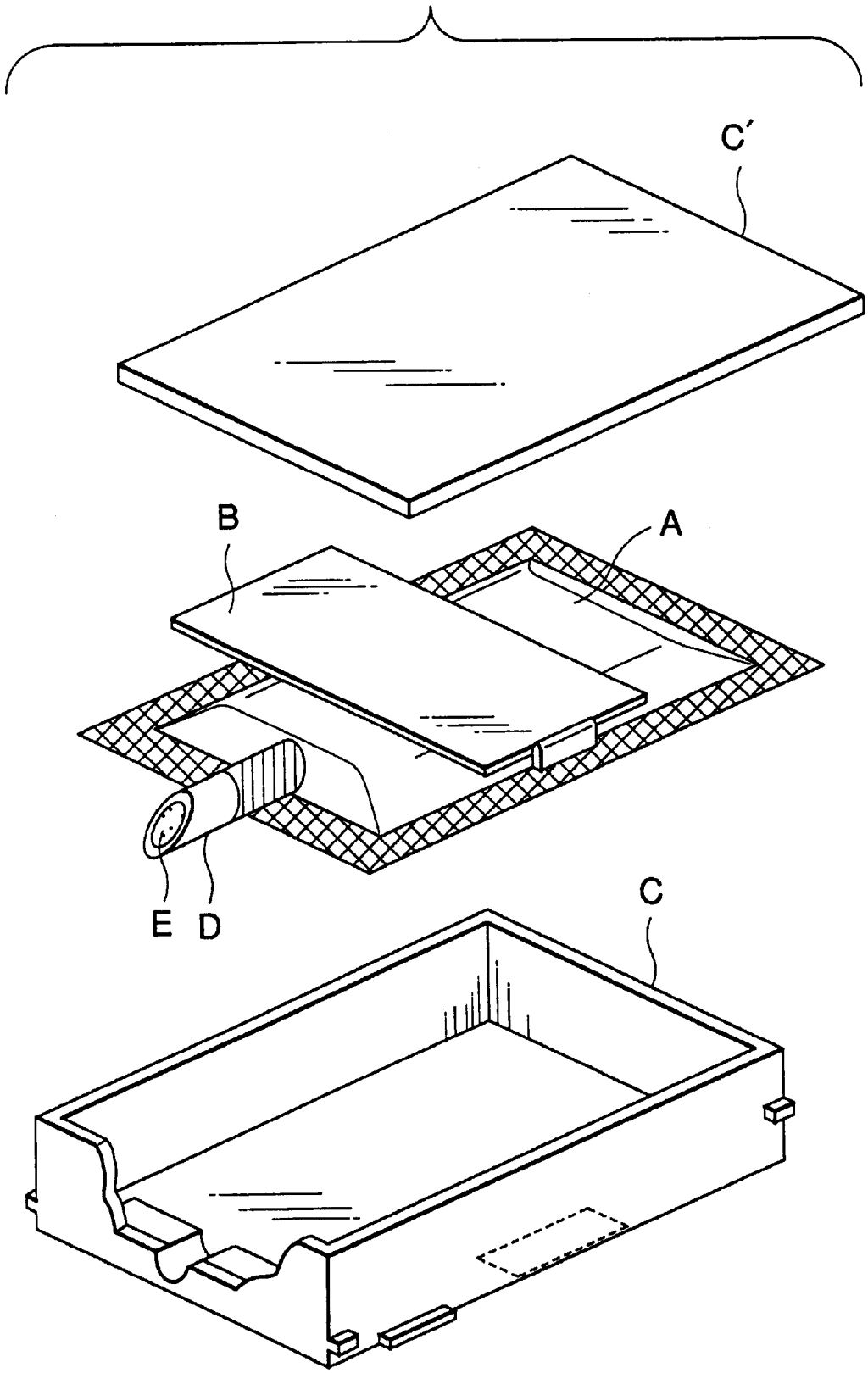
FIG.5 PRIOR ART
FIG. 5 is a diagram showing an example of an ink cartridge for use in a large-sized ink-jet recording head.

Although the flexible ink bag is employed for the relay tank 28 according to the aforesaid embodiment of the invention, the same effect can be achieved by using a sealing container 60 made of metal deaerating material. More specifically, sensors 61, 62 for detecting two kinds of liquid levels, that is, the ink-full and ink-near-end conditions, may be provided; and a flow channel opened via a stop valve 63 to the atmosphere may be formed, as shown in FIG. 4.

According to this embodiment of the invention, the period of the deaerating operation can be extended and the ink quality can also be stabilized by using the main tank 16 as a tentative storage tank, setting the capacity of a relay tank 60 equal to or greater than that of the ink container 20 so as to deaerate the ink poured into the main tank 16 by the deaerator at a stroke and storing the deaerated ink in a relay tank 60.

Although the liquid feeding pump 46 is used for replenishing the relay tank with ink according to the aforesaid embodiment of the invention, the pump 46 can be dispensed with when the head pressure of the main tanks 16–19 is utilizable. Also when the relay tanks 28–31 are small-sized, the carriage may be loaded with the relay tanks.

Figure 6:
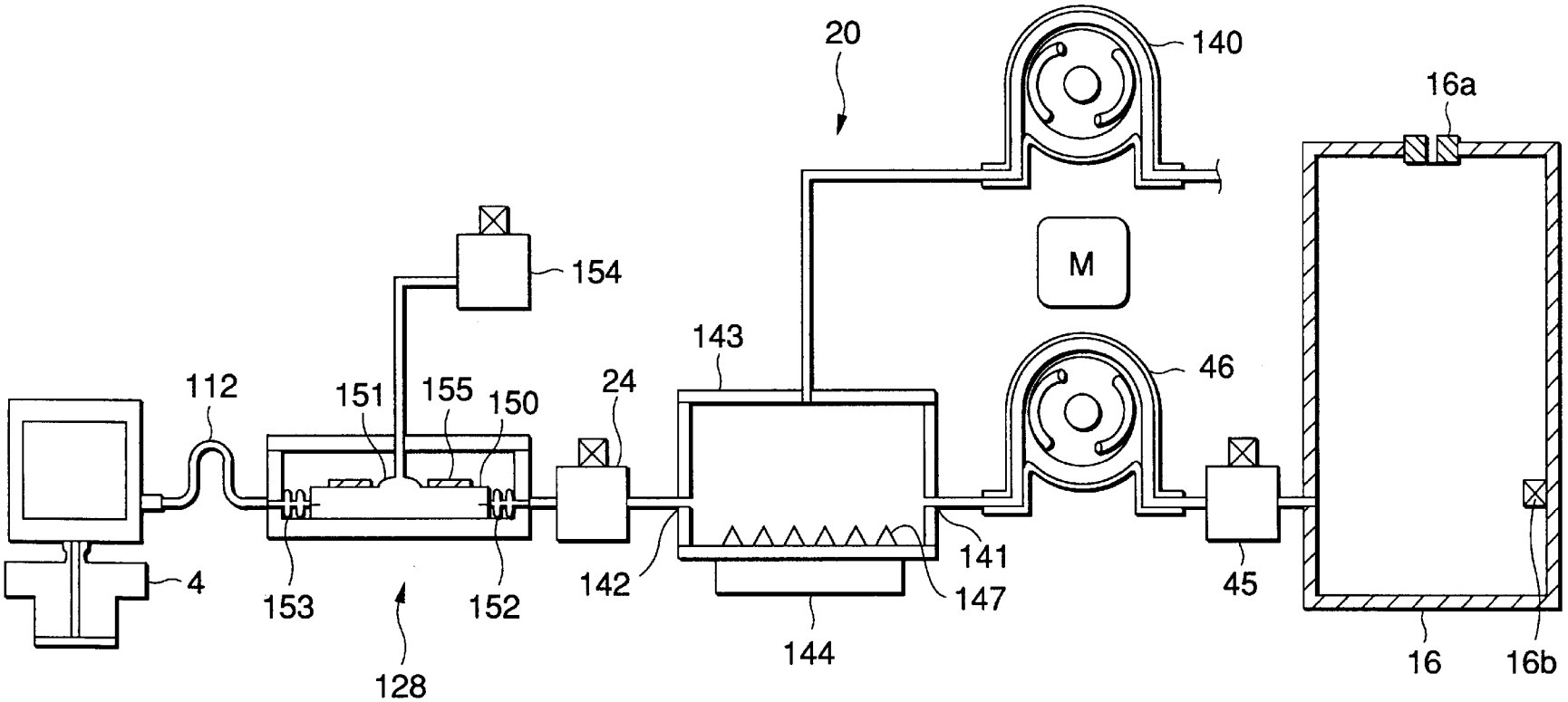
FIG. 6 is a diagram illustrating an arrangement of a flow channel according to another embodiment of the invention.

FIG. 6 shows another embodiment of the present invention. In FIG. 6, like components or parts as shown in FIG. 3 are designated by the same reference numerals. As shown in FIG. 6, the deaerators 20–23 have the same construction and with reference to the deaerator 20 by way of example, it is prepared through the steps of providing an ultrasonic vibrator 144 on the bottom of a container 143 with an upper space on both sides communicating with a suction pump 140, an ink inlet 141 at one end and an ink outlet 142 on the other, and connecting the ink inlet 141 via a stop valve 45 to a liquid feeding pump 46 connected to the main tank 16. Reference numeral 147 in this case denotes a needle-like body for inducing cavitation.

Of the operation of the apparatus of the present embodiment thus constructed, a description will be given of mainly ink replenishment by taking a flow channel connected to the recording head 4, for example. The lid 16*a* of the main tank 16 is opened so as to pour ink and then the lid 16*a* is closed. The stop valve 45 is opened in this state and the vacuum pump 140 is operated to supply ink from the main tank 16 to the deaerator 20 via the liquid feeding pump 46. The ink made to flow into the container 143 receives high-frequency vibration from the ultrasonic vibrator 144 and generates cavitation, and on receiving negative pressure deriving from the vacuum pump 140, isolates and releases the dissolved air by means of the vacuum pump 140.

Figure 7:
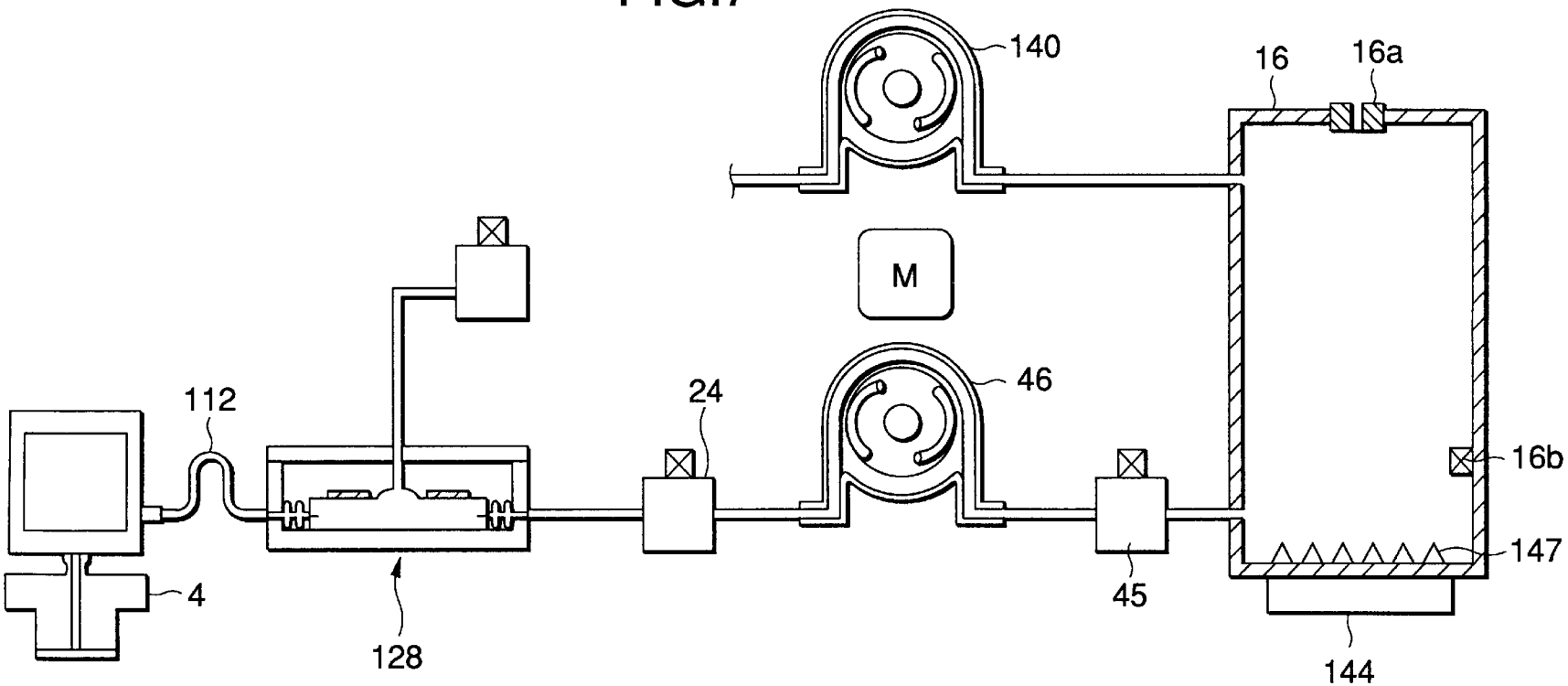
FIG. 7 is a diagram illustrating an arrangement of a flow channel according to still another embodiment of the invention.

Although the container 143 is connected between the main tank 16 and the relay tank 128 so that ultrasonic waves are imparted to the ink in the container 143 according to the aforesaid embodiment of the invention, the ultrasonic vibrator 144 may be provided in the main tank 16 in order to let the negative pressure in the vacuum pump 140 act on the upper space of the main tank as shown in FIG. 7.

Since a large quantity of deaerated ink can be stored according to this embodiment of the invention, the size of the relay tank 128 becomes reducible and consequently the carriage can be loaded with the relay tank 128.

Figure 8:
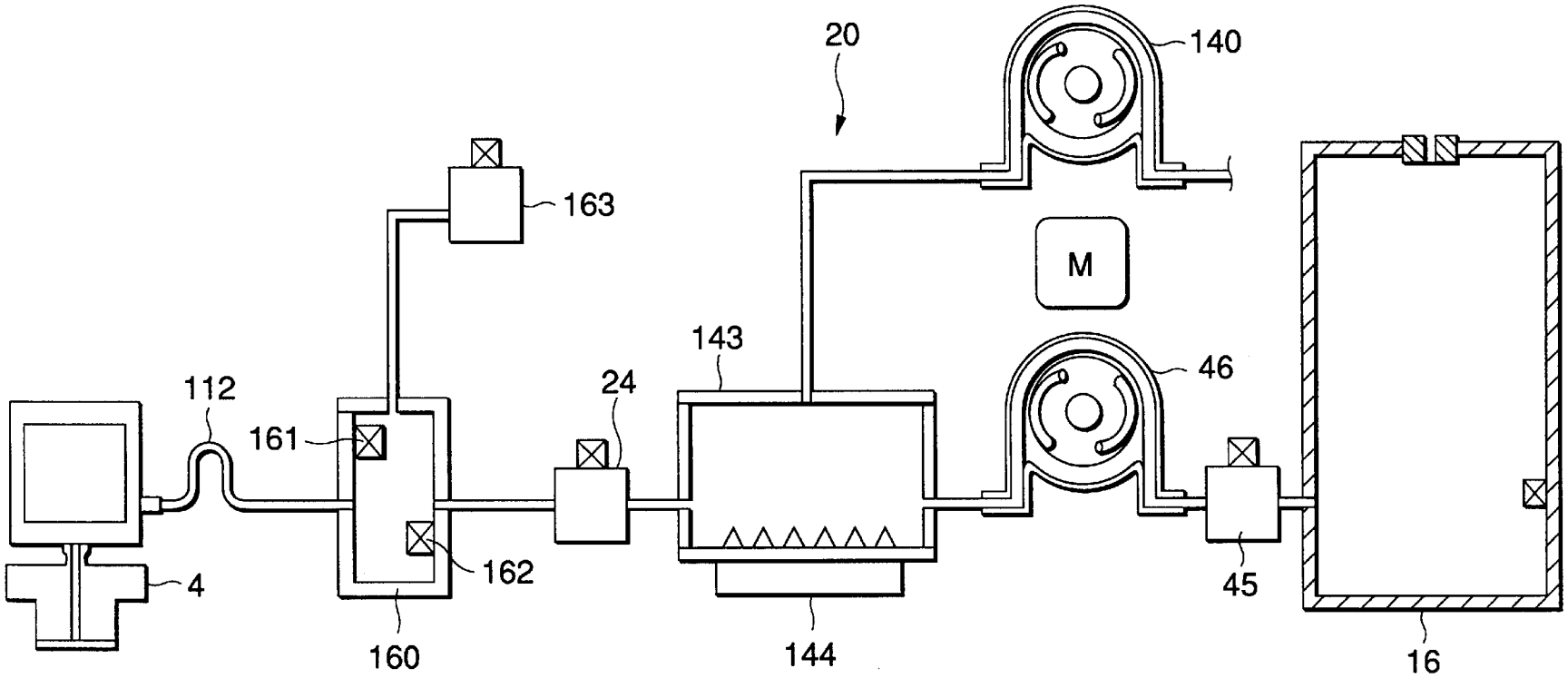
FIG. 8 is a diagram illustrating an arrangement of a flow channel according to still another embodiment of the invention.

Although the flexible ink bag 150 is employed for the relay tank 128 according to the aforesaid embodiment of the invention, the same effect is also achievable when a sealing container 160 made of metal deaerating material is used. More specifically, sensors 161, 162 for detecting two kinds of liquid levels, that is, the ink-full and ink-near-end conditions, may be provided; and besides a flow channel opened via a stop valve 163 to the atmosphere may be formed, as shown in FIG. 8.

Although the deaeration is carried out with high efficiency by irradiation of the ultrasonic waves in such a state that the negative pressure is applied by the vacuum pump according to the aforesaid embodiment of the invention, the vacuum pump can be dispensed with in a case where the deaeration is effected by only the irradiation of the ultrasonic waves to the extent that it is fit for printing.

Although a description has been given of the recording apparatus designed to scan the recording surface while a recording medium is being moved together with the recording head according to the aforesaid embodiment of the invention, the invention is applicable to a recording apparatus of such a type that a recording head with the recording body secured to a flat bed is two-dimensionally moved or that a recording head and a flat bed are moved in perpendicular directions, whereby data is made printable on any medium other than recording paper such as plate materials of metal and polymer by changing only the kind of ink.

As set forth above, according to the present invention, in the ink-jet recording apparatus with the carriage loaded with the recording heads for discharging ink drops according to printing signals by causing the liquid feeding means to supply ink from the ink containers via ink supply tubes to the recording heads, each of the ink containers is adapted for use as a main tank to be supplied with ink which is poured from the outside and also used for supplying the recording head with the ink stored therein via the hollow fibers as the deaerating means which is subjected to the action of negative pressure applied from the outside. Therefore, the replenishment of deaerated ink by replacing the used ink cartridge with a new one can be made unnecessary by deaerating the ink stored in the ink tank before the ink in the ink tank is totally consumed, and printing efficiency is also improved because the operation of filling up a replacement ink cartridge with ink can be dispensed with.

Since the main tank can be replenished with ink by adding ink to the main tank, ink can effectively utilized.

What is claimed is:

1. An ink-jet recording apparatus with a carriage loaded with a recording head for discharging ink drops according to printing signals by causing ink to be supplied to the recording head, comprising:

an ink container which stores ink which is supplied to said recording head;

a de-aerator which de-aerates the ink before it is supplied to said recording head;

a second tank connected between the recording head and the de-aerator, wherein the ink container is adapted for use as a main tank to be supplied with ink from the outside of said ink container, said de-aerator is subjected to the action of negative pressure applied from outside of said de-aerator and said de-aerator supplies ink to said second tank when ink stored in said second tank becomes less than a predetermined amount.

2. An ink-jet recording apparatus as claimed in claim 1, wherein the second tank is provided with ink near-end detector.

3. An ink-jet recording apparatus as claimed in claim 2, further comprising a valve for closing a connection between the de-aerator and the recording head until the de-aerating operation is terminated and after the ink near-end detector detects that the second tank is filled with ink.

4. An ink-jet recording apparatus as claimed in claim 1, wherein the second tank is formed with a flexible ink bag.

5. The ink jet recording apparatus as claimed in claim 1, including a plurality of ink jet heads, ink containers and second tanks.

6. The ink jet recording apparatus as claimed in claim 1, wherein said de-aerator comprises hollow fibers.

7. The ink jet recording apparatus as claimed in claim 1, further comprising a pump which applies negative pressure to said de-aerator.

8. An ink-jet recording apparatus as claimed in claim 7, further including an ink near-end detector, wherein the pump is activated when the ink near-end detector detects that the ink level in the second tank is near-end.

9. The ink jet recording apparatus as claimed in claim 1, further including a stop valve for closing a connection between the de-aerator and the second tank after the second tank is filled with ink.

10. An ink-jet recording apparatus with a carriage loaded with a recording head for discharging ink drops according to printing signals by causing ink to be supplied to the recording head, comprising:

an ink container which stores ink which is supplied to said recording head;

a de-aerator which de-aerates the ink before it is supplied to said recording head;

a second tank connected between the recording head and the de-aerator, wherein the ink container is adapted for use as a main tank to be supplied with ink from the outside of said ink container and said de-aerator supplies ink to said second tank when ink stored in said second tank becomes less than a predetermined amount.

11. An ink-jet recording apparatus as claimed in claim 10, wherein the de-aerator is an ultrasonic vibration imparting device provided between the recording head and the main tank.

12. An ink-jet recording apparatus as claimed in claim 11, wherein negative pressure imparting means is connected to the ultrasonic vibration imparting device.

13. An ink-jet recording apparatus as claimed in claim 12, wherein the second tank is provided with and ink near-end detector.

14. An ink-jet recording apparatus as claimed in claim 13, wherein the ultrasonic vibration imparting device is activated when the ink near-end detector detects that the ink level in the second tank is near-end.

15. An ink-jet recording apparatus as claimed in claim 13, further comprising a valve for closing a connection between the de-aerator and the recording head until a de-aerating operation is terminated and after the ink near-end detector detects that the second tank is filled with ink.

16. An ink-jet recording apparatus as claimed in claim 12, wherein the second tank is formed with a flexible ink bag.

17. An ink-jet recording apparatus as claimed in claim 10, wherein the de-aerator is an ultrasonic-wave imparting device provided in the main tank.

18. An ink-jet recording apparatus as claimed in claim 17, wherein negative pressure imparting means is connected to the main tank.

19. The ink jet recording apparatus as claimed in claim 10, including a plurality of ink jet heads, ink containers and second tanks.

20. The ink jet recording apparatus as claimed in claim 10, further including a stop valve for closing a connection between the de-aerator and the second tank after the second tank is filled with ink.

* * * * *